US008753734B2

(12) United States Patent
Tsai

(10) Patent No.: US 8,753,734 B2
(45) Date of Patent: Jun. 17, 2014

(54) TAP FOR DANCE SHOE

(71) Applicant: Ballet Makers, Inc., Totowa, NJ (US)

(72) Inventor: Chang-Yen Tsai, Lincoln Park, NJ (US)

(73) Assignee: Ballet Makers, Inc., Totowa, NJ (US)

( * ) Notice: Subject to any disclaimer, the term of this patent is extended or adjusted under 35 U.S.C. 154(b) by 0 days.

(21) Appl. No.: 13/654,559

(22) Filed: Oct. 18, 2012

(65) Prior Publication Data

US 2014/0113100 A1 Apr. 24, 2014

(51) Int. Cl.
*A43B 5/12* (2006.01)

(52) U.S. Cl.
USPC ..... 428/119; 36/23; 36/43; 36/88; 36/103; 36/107; 36/113; 36/114; 36/115; 36/116; 36/117.3; 36/132; 36/136

(58) Field of Classification Search
CPC ..... A43B 5/12; A43B 3/0021; A43B 5/005; A43B 13/36
USPC ..... 428/119; 36/88, 103, 107, 113–116, 36/117.3, 132, 136, 23, 43
See application file for complete search history.

(56) References Cited

U.S. PATENT DOCUMENTS 1,967,334 A * 7/1934 Sothen ..... 36/8.3
2,168,303 A * 8/1939 Sothen ..... 36/8.3
4,625,436 A * 12/1986 Stevens, Jr. ..... 36/113
5,001,852 A 3/1991 Schwartz
5,682,685 A 11/1997 Terlizzi
7,434,335 B2 10/2008 Feldstein
2009/0158619 A1 * 6/2009 Wittmers ..... 36/8.3

FOREIGN PATENT DOCUMENTS

EP 0766931 B1 11/1999

* cited by examiner

*Primary Examiner* — Maria Veronica Ewald
*Assistant Examiner* — Brian Handville
(74) *Attorney, Agent, or Firm* — Laubscher & Laubscher, P.C.

(57) ABSTRACT

A toe tap for a tap shoe is characterized by a blunt forward edge which defines a platform for a dance to utilize during dance steps, particularly when the dancer elevates to an elongated pointe position with supported by the tips of the toes. The tap includes a base which has a rear edge extending toward the ball area of the dance shoe and side edges which extend between the front and rear edges. The tap further includes constant perimeter around the side and front portions and a lip extending upwardly from the base at the constant perimeter to enable the dance to execute shuffle and other dance movements with the medial and lateral portions of the foot. A projection further extends from the lip at the front edge. The projection has a flat surface co-planar with the blunt front edge of the base to define a larger platform for supporting the toe tips of the dancer's foot.

11 Claims, 2 Drawing Sheets

TAP FOR DANCE SHOE

BACKGROUND OF THE INVENTION

In many styles of dance, the dancer performs dance moves on the tip of a dance shoe. There are numerous movements including variations of toe stands and toe drops. These movements occur in all genre of dance: pointe, ballet, tap, jazz, character, modern, hip hop, and the like. There have been innovations that have helped the dancer achieve a more stable or prolonged position "en pointe" or on the tip toes. These prior innovations include adding a platform or similar type of flat surface to the toe area of the dance shoe to help execute the movements. This solution has been previously applied to pointe shoes and dance sneakers. Until now, there has not been the same innovation adapted for, and applied to, tap shoes.

While performing, practicing or studying the art of tap dance, the dancer may be required to stand on the toe or tip of the shoe. To execute this motion, the dancer lifts upwards and forwards through their body and their feet using their shoe as a tool to get them on pointe and keep them there. The shoe protects the foot and provides strength to the foot in order to complete this motion. Due to the nature of tap shoes as they have traditionally been made, the dancer is forced to stand on the rounded front portion of the tap which is mounted on the sole of the shoe. This is prohibitive to achieving optimal balance and affects both short and prolonged toe stands. It also hinders the ability of the dancer to string dance moves and motions together while "en pointe", because the rounded tip forces the dancer to unnecessarily work harder in order to achieve the proper body alignment and position. Extra effort is required to maintain proper and safe technique and produce the required/desired sound to achieve the art as it is meant to be heard and seen. Since there is no safe area for the dancer to balance on existing taps and related footwear, there is an added risk for injury while performing such intricate and technical footwork and body motion.

In addition to utilizing the tap in the front or toe portion of the shoe, tap dancers also utilize the side portions of the sole of the shoe. There are dance movements that require dancers to produce sounds while engaging in scuffing movements using the inside and outside edge of the shoe's sole. Since the sound producing metal tap portion of a tap shoe does not always extend to be flush with the edge of the shoe's sole construction, for reasons varying from shoe size to last shape, producing a sound utilizing the edge of the sides of the foot can be difficult. The toe tap is frequently arranged further in towards the center of the ball of the foot of the shoe, leaving an area of the sole of the shoe exposed around the tap, i.e. framing the tap, preventing it from being easily accessible at the edges of the shoe. In order to access this area of the foot, and thereby generating the tapping sound, the dancer must twist the foot and ankle into positions that can create injury, either immediately, or over time. While the motion and desired sound result is achievable, the tap shoes used to achieve it could be improved upon to reduce the possibility of injury.

SUMMARY OF THE INVENTION

Accordingly, it is a primary object of the invention to provide a tap for a dance shoe wherein the tap includes a base having a forward edge adjacent to the toe area of the dance shoe, a rear edge extending toward the ball area of the dance shoe, and side edges between the toe and rear edges. The side edges of the tap extend toward the side edges of the shoe. A projection extends upwardly from the base forward edge. The projection and base forward edge have a flat configuration to define a support platform which provides stability to the dancer when performing certain dance movements where the dancer elevates onto the toes of the feet.

The side edges of the base have a constant perimeter which is configured to match the outer perimeter of the sole of the dance shoe. The base side edges have a curvature defined by a gradual transition of radius which increases from the rear edge to the forward edge.

According to a preferred embodiment of the invention, the perimeter of the side edges of the base is co-linear with the outer perimeter of the dance shoe sole. In addition, the base includes a lip which extends upwardly and continuously around the perimeter of the side and forward edges. The projection extends upwardly from the lip.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
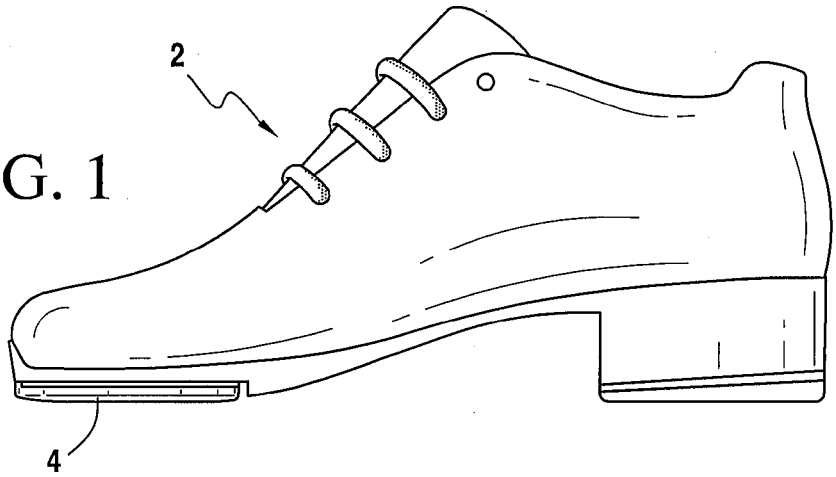
FIG. 1 is a side view of a dance shoe having a tap according to the invention connected with the shoe.

In FIG. 1 there is shown a dance shoe 2 such as a tap dance shoe having a tap 4 according to the invention connected with the toe region of the shoe sole. Such a tap is often referred to as a toe tap. In addition, most tap shoes also include a heel tap (not shown) connected with the heel region of the shoe sole. The tap is preferably made of metal to produce a distinctive sound during tap dancing as will be developed below. Suitable metals include aluminum, carbon fiber, steel, iron and graphite. Alternatively, the tap may be made of a metal polymer, acrylic, plastic, leather, or any other sound producing material. The tap material may be anodized, galvanized, or electroplated depending on the needs of the dancer.

The tap 4 is shown in detail in the remaining FIGS. 2-11 of the drawing. As shown therein, it includes a base 6 which has a generally triangular configuration. A forward edge 8 of the tap is arranged adjacent to the toe end of the dance shoe as shown in FIG. 1, and a rear edge 10 of the tap is arranged toward the portion of the shoe sole which covers the ball of the dancer's foot. Side edges 12 extend between the forward edge 8 and the rear edge 10. The side edges extend toward the side edges of the dance shoe sole.

Figure 5:
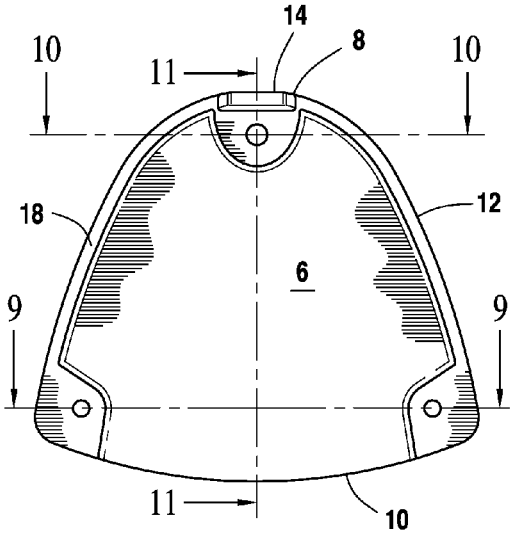
Figure 6:
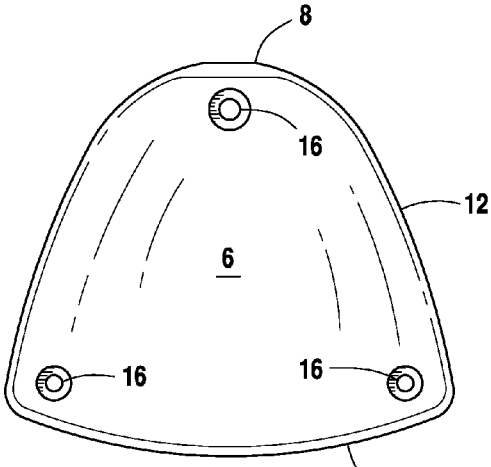
Figure 11:
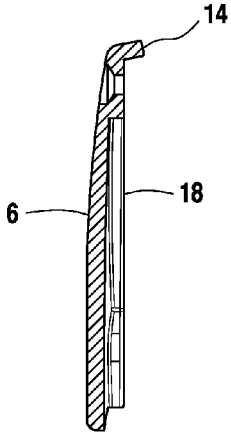
FIG. 11 is a sectional view of the tap taken along line 11-11 of FIG. 5.

As shown particularly in FIGS. 5 and 6, the forward edge 8 of the tap is blunt or flattened. In taps of the prior art, the front edge of the tap is traditionally rounded and follows the round toe shape of the shoe and the last used in the construction and formation of the shoe. Such traditional taps are separate from the toe box and outsole of the tap shoe creating a gap between the tap and the shoe sole. When a dancer moves to a toe stand or similar position, the dancer is not even standing on the toe box, which is also round, but rather on the rounded tap. This is slippery and dangerous, issues which are compounded by the gap between the tap and shoe. There is no place on the shoe or tap for the dancer to balance, thereby increasing the risk for injury.

The flatter surface area at the forward edge 8 creates a platform so that there is a place for the dancer to find stability during specific types of movement. This surface will counteract the round shape of the toe portion of the dance shoe, thus acting like a buttress between the dancer and the dance floor. The flattened front edge portion of the base of the tap is rounded at the opposite ends where the front edge merges into the side edges of the tap. Thus, there are no hard corners that detract from the overall aesthetic or traditional look of the tap shoe.

The flat tap platform area may extend from the outer perimeter of the tap, although this is not required. If so, the extension is relatively small, on the order of 1 mm on the dorsal side tip of the toe, positioned on the perpendicular plane relative to the strike zone of the tap. The flattened forward edge of the tap further includes a projection 14 which extends upwardly from the tap. The projection extends vertically up the front portion of the dance shoe. The projection is preferably integral with the base of the tap so that it is formed from one continuous piece of material and has a thickness corresponding to the thickness of the base as shown in FIGS. 2, 7, 9 and 11.

Figure 2:
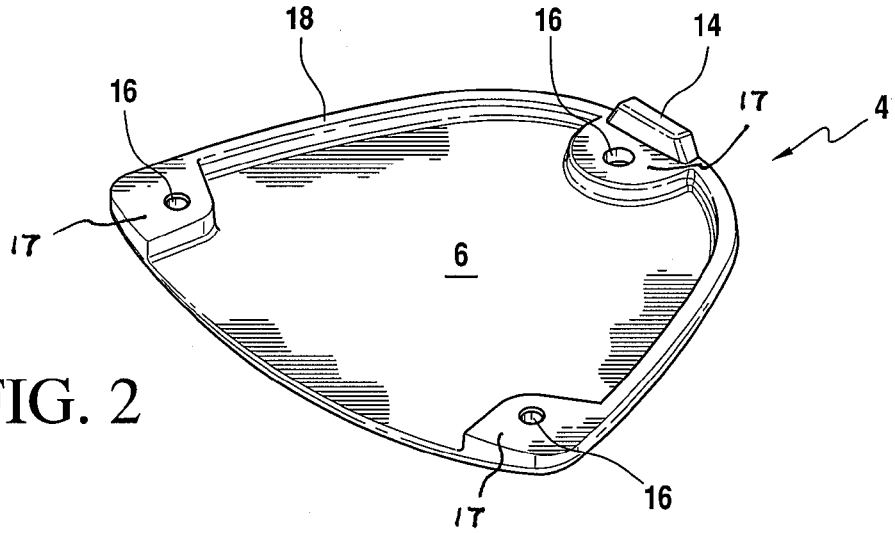
FIGS. 2 and 3 are top and bottom perspective views, respectively, of the tap according to a preferred embodiment of the invention.

The tap includes at least one opening 16 which is used to connect the tap to the sole of the shoe. In the drawing, a plurality of openings is shown. The openings are arranged in raised platforms 17 extending from the upper surface of the tap base 6 as shown in FIG. 2. The openings are adapted to receive screws, studs or other fasteners to connect the tap to the shoe sole. The tap can be designed to standard dimensions and serve as a replacement tap on a standard tap shoe. Alternatively, the tap shoe can be modified to include a blunt forward sole edge to match the flattened portion of the tap forward edge. Dancers prefer that the tap fit snugly against the edges of the sole of the dance shoe to provide a clean visual line of the tap all around the profile of the toe. In addition, a proper fit of the tap provides a higher quality sound and enables the dancer to execute tap movements that utilize scuffs or sound producing motions on the medial and lateral portions of the foot.

The tap 4 according to the present invention is designed with a constant outer tap perimeter, particularly along the side edges 12 of the base. The constant perimeter allows a dancer to execute a dance movement with a higher degree of accuracy and technical ability while reducing the amount of physical effort required. It also provides a cleaner aesthetic at the profile of the shoe. The perimeter of the tap portion may extend up to 2 mm from the edge of the shoe sole and may taper toward the toe platform or toward the rear edge of the tap base. The shape of the tap will always follow the shape of the shoe sole. The curvature of the perimeter is defined by a gradual transition of radius which increases from the rear edge to the forward edge of the base.

Figure 3:
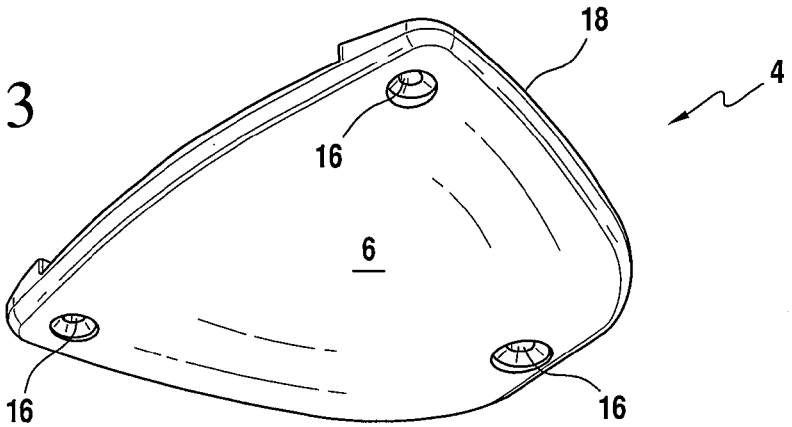
Figure 4:
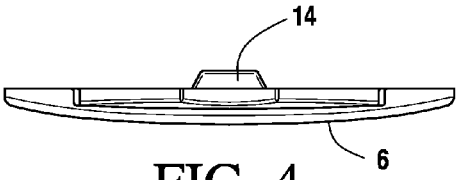
FIGS. 4, 5, and 6 are front, top and bottom plan views of the tap according to the invention.
Figure 7:
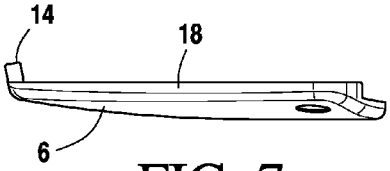
FIGS. 7 and 8 are left and right side plan views of the tap shown in FIGS. 4-6.
Figure 8:
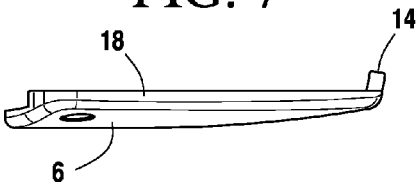

According to a preferred embodiment, the base includes an integral lip 18 extending upwardly and continuously around the perimeter of the side and forward edges as shown particularly in FIGS. 3 and 5. The lip follows the shape of the last used to form the dance shoe. It is in the form of a thin wall of tap material that covers the outer edge of the toe portion of the sole and the medial and lateral sides of the shoe as shown in FIG. 1. In the tap front edge, the projection 14 extends upwardly from the lip 18 as shown for example in FIG. 2.

The tap is wide enough to accommodate several shoe sizes without changing the profile of the shoe. Thus, the tap can be applied to any tap shoe, as it is not limited to just one specific shoe model. The tap is snug fit to the shoe without sacrificing the tap cavity between the base portion 4 and the shoe sole or the ability for the tap to produce the desired sound.

Figure 9:
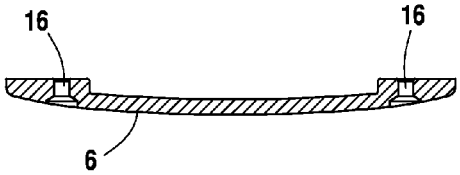
FIG. 9 is a sectional view of the tap taken along line 9-9 of FIG. 5.
Figure 10:
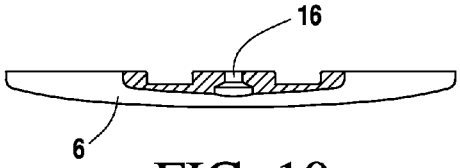
FIG. 10 is a sectional view of the tap taken along line 10-10 of FIG. 5.

The bottom surface of the base is preferably contoured rather than flat. As shown in FIGS. 9 and 10, for example, the base bottom surface has a convex configuration.

With the lip on the tap extending upwardly and over the side edges of the shoe sole, it is easier for the dancer to execute tap movements that utilize scuffs and sound producing motions on the medial and lateral portions of the foot. This is a vast improvement over prior taps which were centered in the strike zone but did not extend to the edge of the shoe or beyond. With the improved tap according to the invention, the dancer is not required to force the foot unnaturally beyond its normal inversion and eversion range in order to effectively sound the tap. This reduces repetitive stress injuries.

While the preferred forms and embodiments of the invention have been illustrated and described, it will be apparent to those of ordinary skill in the art that various changes and modifications may be made without deviating from the inventive concepts set forth above.

What is claimed is:

1. A tap for the forward portion of a dance shoe sole, comprising a base including a forward edge adjacent to the toe area of the dance shoe sole, a rear edge extending toward the ball area of the dance shoe sole, side edges between said toe and rear edges, and a lip extending continuously around a perimeter of said side and forward edges, said base side edges having a radius of curvature defined by a transition of radius between said rear edge and said forward edge, said base side edges extending toward side edges, respectively, of the dance shoe sole, said base forward edge having a flat configuration and a projection extending upwardly therefrom, said projection having a flat configuration, a thickness corresponding with a thickness of said base, and a forward surface co-planar with said flat forward edge of said base to provide stability to the dancer when performing certain dance movements, said base forward edge further having rounded opposite end edges which merge into said base side edges, said base further including a platform arranged rearwardly of said projection.

2. A tap as defined in claim 1, wherein said projection extends upwardly onto the sole of the dance shoe.

3. A tap as defined in claim 1, wherein said side edges have a constant perimeter configured to match the outer perimeter of the dance shoe sole.

4. A tap as defined in claim 1, wherein said transition of radius of curvature increases from said rear edge to said forward edge.

5. A tap as defined in claim 3, wherein the perimeter of said side edges is co-linear with the outer perimeter of the sole of the dance shoe.

6. A tap as defined in claim 3, wherein the perimeter of said side edges extends beyond the outer perimeter of the dance shoe sole.

7. A tap as defined in claim 1, wherein said projection extends upwardly from said lip.

8. A tap as defined in claim 1, wherein said base has a contoured bottom surface.

9. A tap as defined in claim 8, where said contoured bottom surface is convex.

10. A tap as defined in claim 1, wherein said platform contains a through-opening for receiving a fastener to connect the tap with the dance shoe sole.

11. A tap as defined in claim 10, wherein said base contains second and third platforms adjacent said side and rear edges, said second and third platforms containing through-openings for receiving fasteners to connect the tap with the dance shoe sole.

* * * * *